US012458829B2

(12) United States Patent
Tsai

(10) Patent No.: US 12,458,829 B2
(45) Date of Patent: Nov. 4, 2025

(54) LEG LIFT MACHINE OF MAGNETICALLY CONTROLLED RESISTANCE TYPE

(71) Applicant: Yu-Lun Tsai, Taichung (TW)

(72) Inventor: Yu-Lun Tsai, Taichung (TW)

( * ) Notice: Subject to any disclaimer, the term of this patent is extended or adjusted under 35 U.S.C. 154(b) by 146 days.

(21) Appl. No.: 18/390,336

(22) Filed: Dec. 20, 2023

(65) Prior Publication Data

US 2025/0205539 A1 Jun. 26, 2025

(51) Int. Cl.

| | |
|---|---|
| ***A63B 21/00*** | (2006.01) |
| ***A63B 21/22*** | (2006.01) |
| ***A63B 22/00*** | (2006.01) |

(52) U.S. Cl.

CPC ..... *A63B 21/00192* (2013.01); *A63B 21/22* (2013.01); *A63B 21/4034* (2015.10); *A63B 21/4035* (2015.10); *A63B 21/4047* (2015.10); *A63B 22/0056* (2013.01)

(58) Field of Classification Search

CPC ..... A63B 21/00192; A63B 21/22; A63B 21/4034; A63B 21/4035; A63B 21/4047; A63B 22/0056; A63B 22/0064; A63B 2022/0617; A63B 2022/067

See application file for complete search history.

(56) References Cited

U.S. PATENT DOCUMENTS

| | | | | |
|---|---|---|---|---|
| 7,097,596 | B2 * | 8/2006 | Yang | A63B 21/4049 482/57 |
| 12,220,606 | B2 * | 2/2025 | Liao Lai | F16H 57/02 |
| 12,337,203 | B1 * | 6/2025 | Tsai | A63B 21/4034 |
| 2023/0054522 | A1 * | 2/2023 | Liao Lai | A63B 21/154 |

FOREIGN PATENT DOCUMENTS

| | | | | |
|---|---|---|---|---|
| DE | 202023107539 | U1 * | 1/2024 | A63B 22/0056 |
| DE | 202025100249 | U1 * | 1/2025 | A63B 22/0056 |

* cited by examiner

*Primary Examiner* — Megan Anderson
(74) *Attorney, Agent, or Firm* — LANWAY IPR SERVICES; Chun-Ming Shih

(57) ABSTRACT

A leg lift of a magnetically controlled resistance type machine includes a main frame unit, a seat, two drive levers, two pedals, a linkage mechanism, two swinging mechanisms, and a magnetically controlled resistance mechanism. The seat is mounted on the main frame unit. The two pedals are mounted on the drive levers. The drive levers are connected with and limited by the linkage mechanism to reciprocally swing forward and backward and to move along a curved trajectory. The swinging mechanisms are pivotally connected with and driven by the two drive levers. The magnetically controlled resistance mechanism is connected with the swinging mechanisms, to provide a resistance to the drive levers through the swinging mechanisms. The magnetically controlled resistance mechanism includes multiple belt wheels to produce a larger speed ratio and to provide a larger resistance.

10 Claims, 11 Drawing Sheets

LEG LIFT MACHINE OF MAGNETICALLY CONTROLLED RESISTANCE TYPE

BACKGROUND OF THE INVENTION

Field of the Invention

The present invention relates to an exercising machine and, more particularly, to a leg lift (or raise or extension) machine of a magnetically controlled resistance type.

Description of the Related Art

A conventional leg lift machine generally comprises a base, a front handle support, a seat mount, a driving mechanism, a magnetically controlled resistance mechanism, and a linkage mechanism. The driving mechanism includes two driving levers. Each of the driving levers has a first end swingably connected to the seat mount and a second end pivotally connected with a pedal. The driving mechanism further includes sprockets and chains mounted between the seat mount and the driving levers. The magnetically controlled resistance mechanism is driven by the sprockets in a one-way direction to produce a resistance. The linkage mechanism is connected with the driving levers so that the driving levers swing in two opposite directions.

However, the conventional leg lift machine has the following disadvantages.

1. The sprockets and the chains are expensive and increase the cost of production. In addition, it will take much time to adjust the sprockets and the chains so that the sprockets and the chains are rotated smoothly, thereby prolonging the time of assembly and increasing the cost of fabrication.

2. The magnetically controlled resistance mechanism is operated by an eddy current and does not have an inertia effect so that the user is not easily accustomed to the magnetically controlled resistance mechanism.

BRIEF SUMMARY OF THE INVENTION

The primary objective of the present invention is to provide a leg lift machine that produces a larger resistance or damping effect.

In accordance with the present invention, there is provided a leg lift machine comprising a main frame unit, a seat, two drive levers, two pedals, a linkage mechanism, two swinging mechanisms, and a magnetically controlled resistance mechanism. The main frame unit includes a handle support, a seat support module, and a connecting bar. The handle support is arranged at a front section of the main frame unit. The handle support is provided with a handle and a support brace. The seat support module is arranged at a rear section of the main frame unit. The seat support module includes a front support and a rear support. The connecting bar is connected between the handle support and the seat support module. The seat is mounted on the seat support module. The two drive levers are arranged on two sides of the seat support module. Each of the two drive levers has a first end and a second end. The first end of each of the two drive levers is pivotally mounted on the seat support module. Thus, the first end of each of the two drive levers is served as a rotation fulcrum, and the two drive levers are pivoted relative to the main frame unit and reciprocally swing forward and backward and move along a curved trajectory. Each of the two pedals is pivotally mounted on the second end of one of the two drive levers. The linkage mechanism includes a swing base and two linkage rods. The swing base is pivotally mounted on the seat support module and symmetrically swings leftward and rightward. Each of the two linkage rods has a lower end pivotally connected with one of two ends of the swing base. Each of the two linkage rods has an upper end pivotally connected with the first end of one of the two drive levers. Thus, the two drive levers are limited by the swing base and the two linkage rods to reciprocally swing forward and backward. The two swinging mechanisms are arranged on two sides of the main frame unit. Each of the two swinging mechanisms includes a rear swinging lever, a pivot member, and a lower swinging lever. The rear swinging lever has an upper end pivotally connected with the first end of one of the two drive levers. The rear swinging lever has a lower end pivotally connected with a first end of the pivot member. The pivot member has a second end pivotally connected with a rear end of the lower swinging lever. The magnetically controlled resistance mechanism is arranged on the front section of the main frame unit. The magnetically controlled resistance mechanism is driven by a front end of the lower swinging lever, and provides a resistance to the lower swinging lever of each of the two swinging mechanisms. The magnetically controlled resistance mechanism at least includes a first belt wheel, a second belt wheel, a third belt wheel, a first rotation wheel, a second rotation wheel, a third rotation wheel, a fourth rotation wheel, a magnetically controlled wheel, and a magnetic bracket. The first belt wheel, the first rotation wheel, the third belt wheel, and the third rotation wheel are pivotally mounted on a first side of the main frame unit. The second belt wheel, the second rotation wheel, the fourth rotation wheel, the magnetically controlled wheel, and the magnetic bracket are pivotally mounted on a second side of the main frame unit. The magnetic bracket surrounds a periphery of the magnetically controlled wheel. The first rotation wheel is coaxial with the second belt wheel. The first rotation wheel is rotated in concert with the second belt wheel synchronously. The second rotation wheel is coaxial with the third belt wheel. The second rotation wheel is rotated in concert with the third belt wheel synchronously. The third rotation wheel is coaxial with the magnetically controlled wheel. The third rotation wheel is rotated in concert with the magnetically controlled wheel synchronously. The magnetically controlled resistance mechanism further includes a first transmission belt mounted around the first belt wheel and the first rotation wheel, a second transmission belt mounted around the second belt wheel and the second rotation wheel, and a third transmission belt mounted around the third belt wheel and the third rotation wheel. The first belt wheel is coaxial with the fourth rotation wheel. The first belt wheel is rotated in concert with the fourth rotation wheel synchronously. The magnetically controlled resistance mechanism further includes two cranks pivotally connected with the first belt wheel and the fourth rotation wheel respectively. Each of the two cranks is pivotally connected with the front end of the lower swinging lever of one of the two swinging mechanisms.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
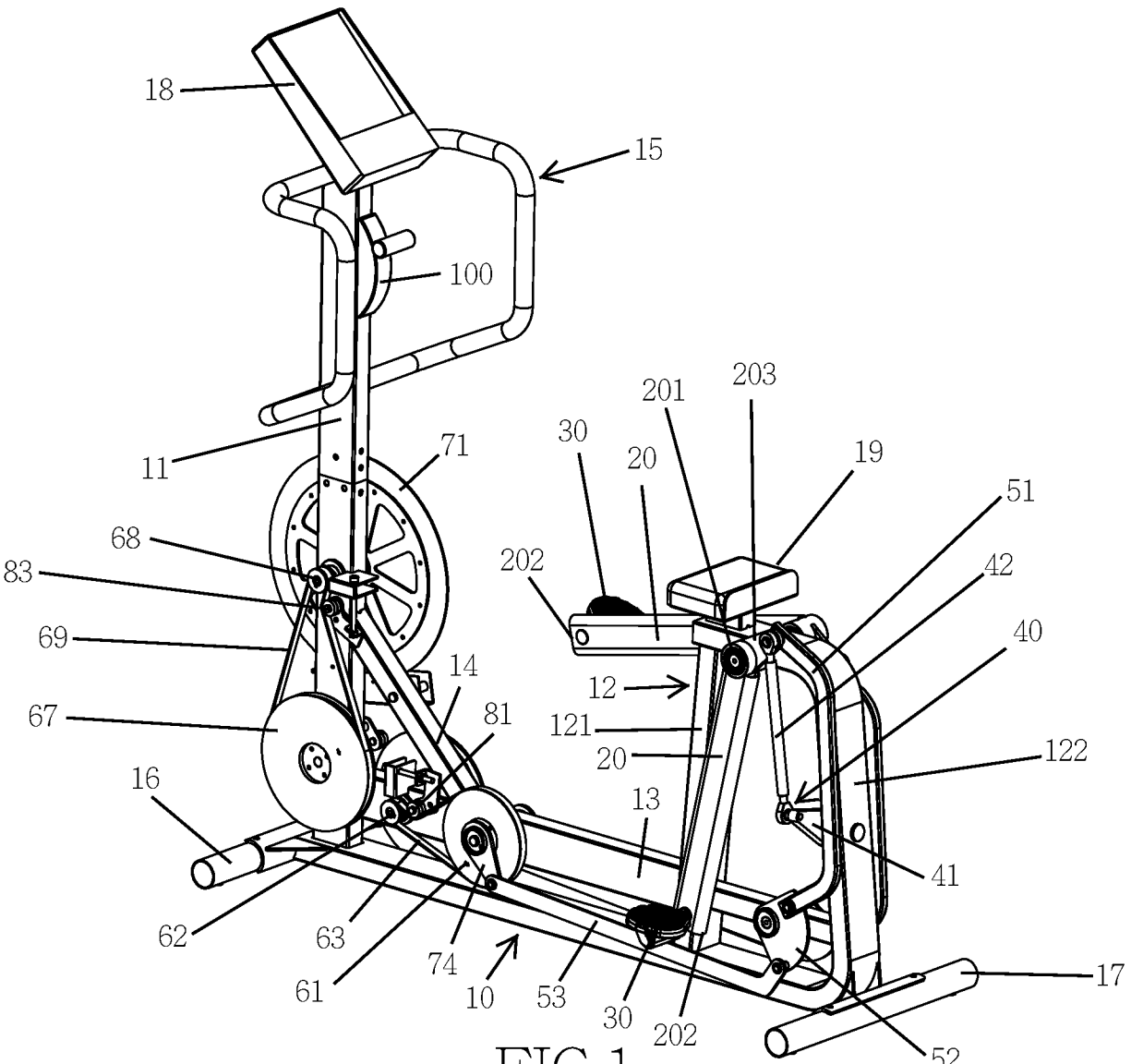
FIG. 1 is a perspective view of a leg lift machine in accordance with the first preferred embodiment of the present invention.
Figure 2:
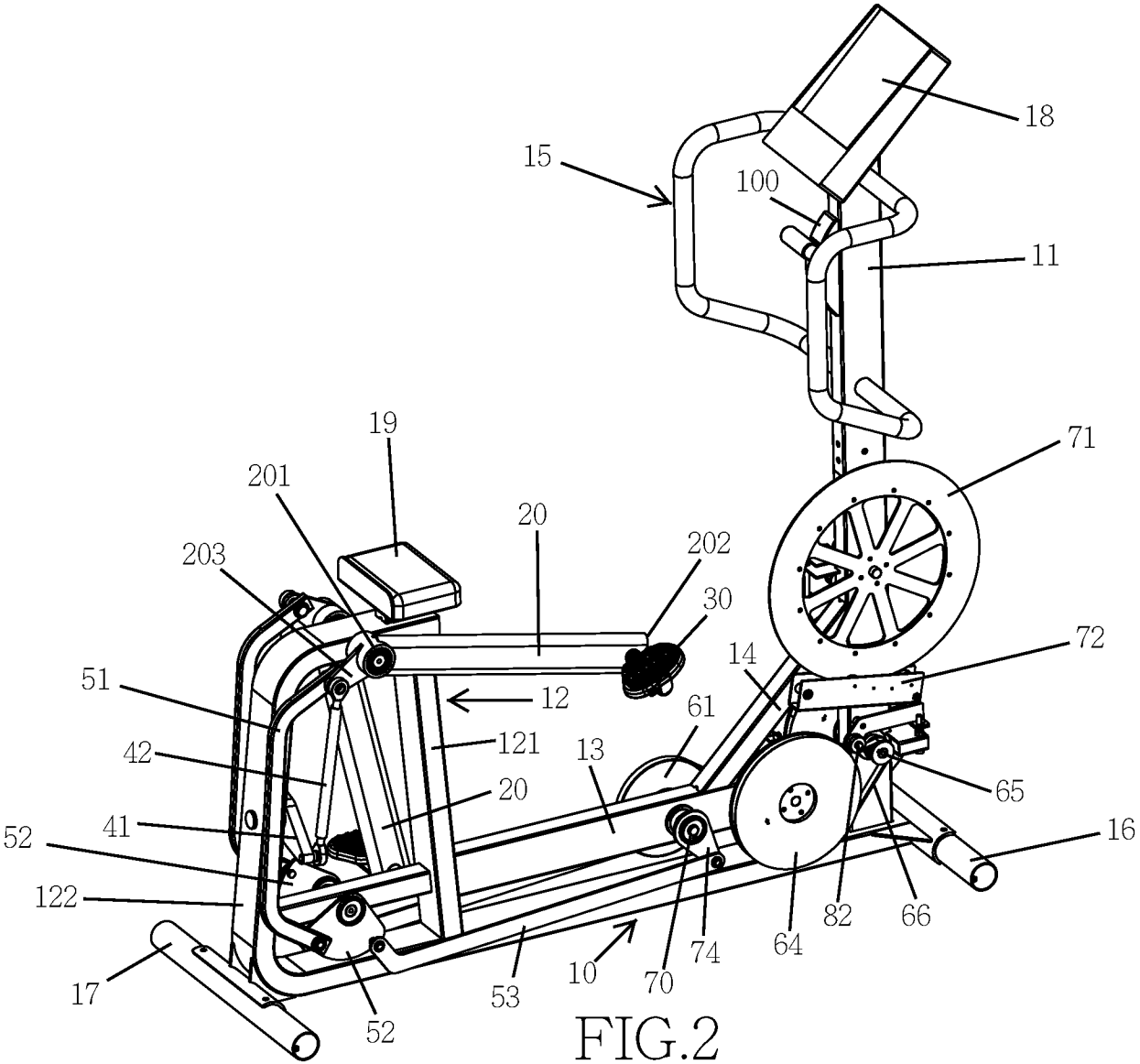
FIG. 2 is another perspective view of the leg lift machine as shown in FIG. 1.
Figure 3:
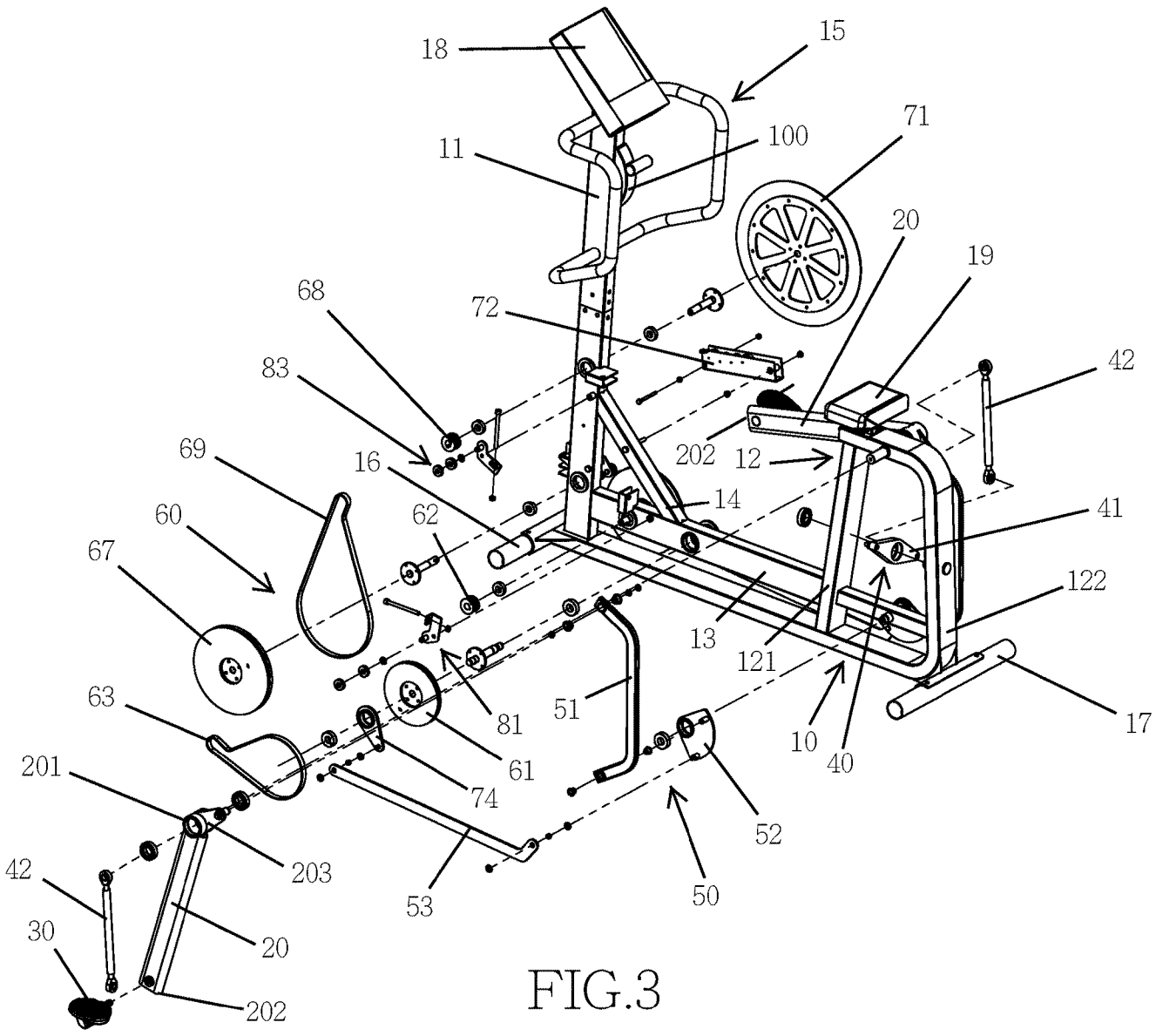
FIG. 3 is an exploded perspective view of the leg lift machine as shown in FIG. 1.
Figure 4:
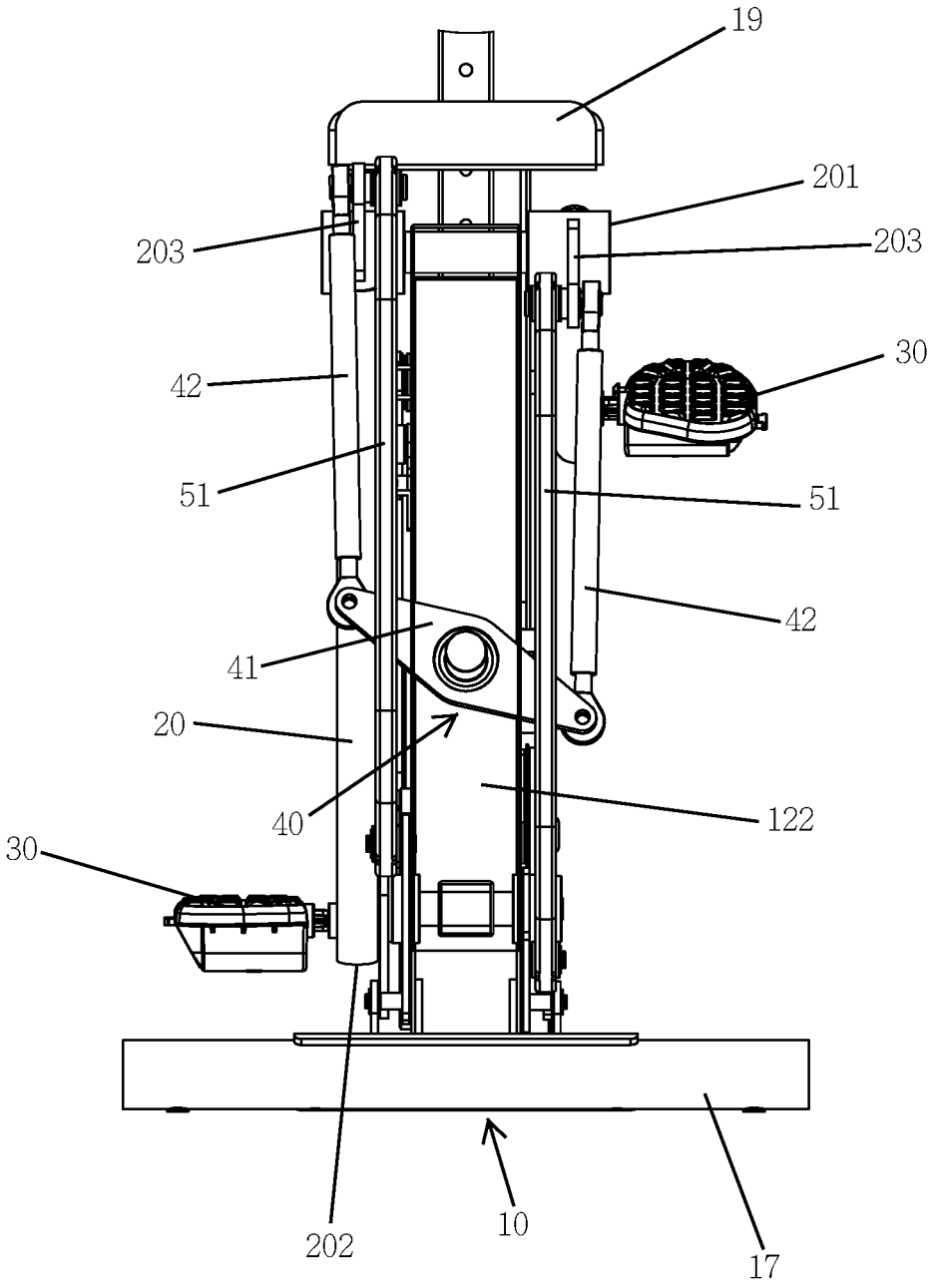
FIG. 4 is a partial rear view of the leg lift machine as shown in FIG. 1.
Figure 5:
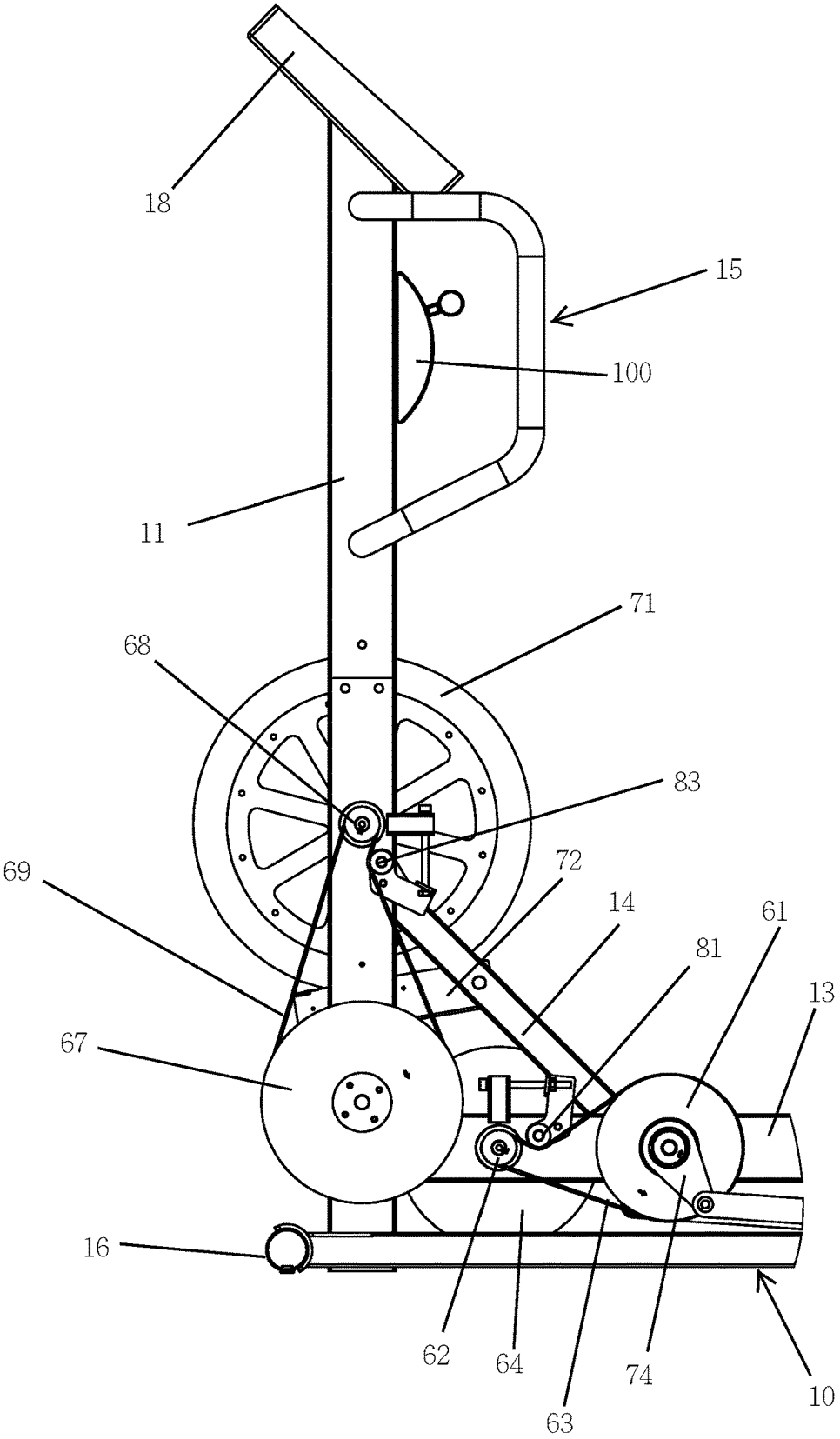
FIG. 5 is a locally enlarged partial side view of the leg lift machine as shown in FIG. 1.
Figure 6:
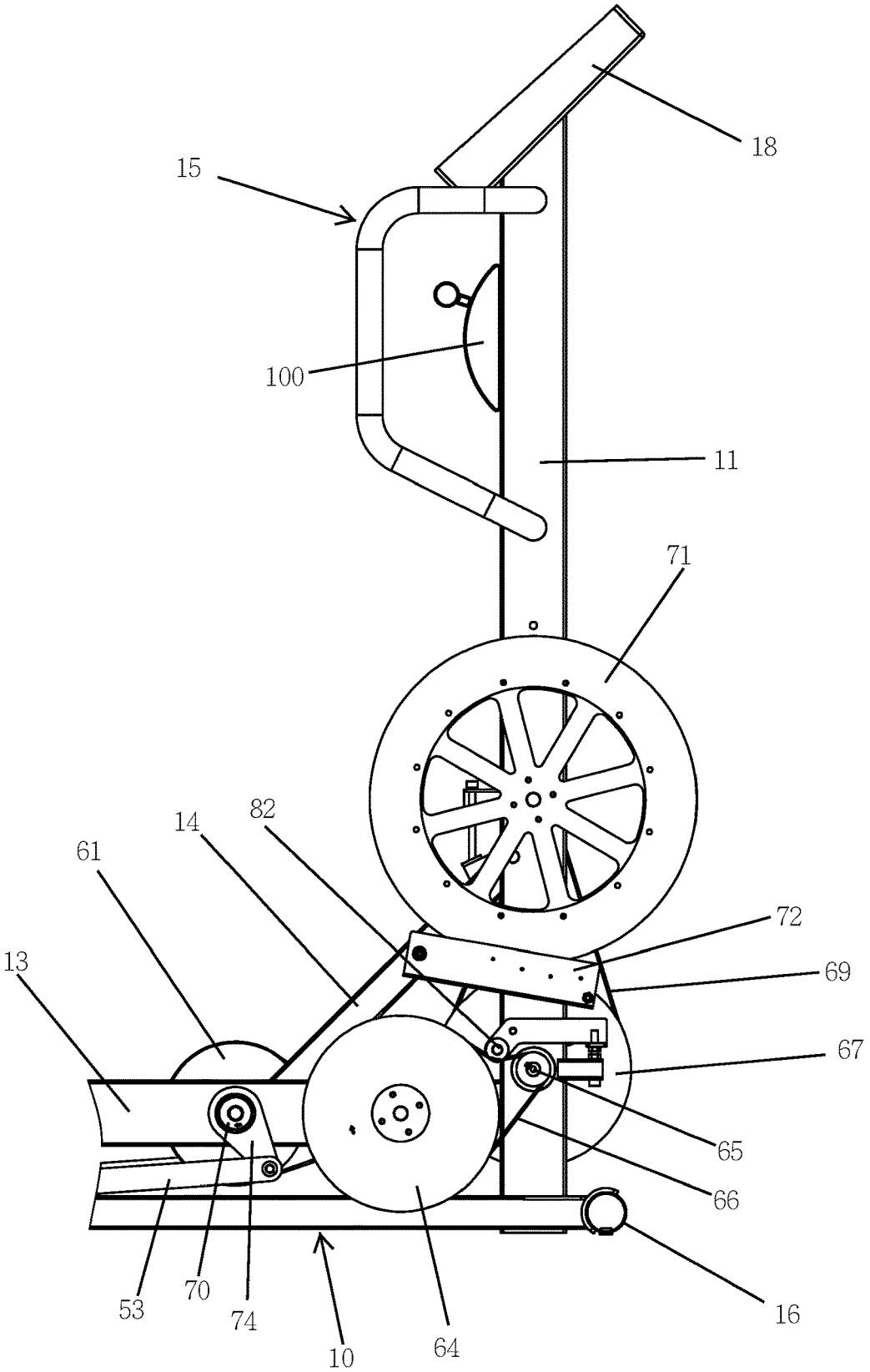
FIG. 6 is a locally enlarged partial side view of the leg lift machine as shown in FIG. 2.

Referring to the drawings and initially to FIGS. 1-7, a leg lift machine of a magnetically controlled resistance type in accordance with the preferred embodiment of the present invention comprises a main frame unit 10, a seat 19, two drive levers 20, two pedals 30, a linkage mechanism 40, two swinging mechanisms 50, and a magnetically controlled resistance mechanism 60.

The main frame unit 10 includes a handle support (or stand) 11, a seat support module 12, and a connecting bar 13. The handle support 11 is arranged at a front section of the main frame unit 10. The handle support 11 is provided with a handle (or handgrip) 15, a control panel 18, and a support brace 14. The seat support module 12 is arranged at a rear section of the main frame unit 10. The seat support module 12 includes a front support 121 and a rear support 122. The connecting bar 13 is connected between the handle support 11 and the seat support module 12. Preferably, the front section of the main frame unit 10 is provided with a transverse rod 16 placing on the ground, and the rear section of the main frame unit 10 is provided with a transverse rod 17 placing on the ground. The seat 19 is mounted on the seat support module 12.

The two drive levers 20 are arranged on two sides of the seat support module 12. Each of the two drive levers 20 has a first end 201 and a second end 202. The first end 201 of each of the two drive levers 20 is pivotally mounted on the seat support module 12. Thus, the first end 201 of each of the two drive levers 20 is served as a rotation fulcrum, and the two drive levers 20 are pivoted relative to the main frame unit 10 and reciprocally (or alternatingly) swing forward and backward and move along a curved trajectory (or track). Each of the two pedals 30 is pivotally mounted on the second end 202 of one of the two drive levers 20.

The linkage mechanism 40 includes a swing base 41 and two linkage rods 42. The swing base 41 is pivotally mounted on the seat support module 12 and symmetrically swings leftward and rightward. Each of the two linkage rods 42 has a lower end pivotally connected with one of two ends of the swing base 41. Each of the two linkage rods 42 has an upper end pivotally connected with the first end 201 of one of the two drive levers 20. Thus, the two drive levers 20 are limited by the swing base 41 and the two linkage rods 42 to reciprocally swing forward and backward.

The two swinging mechanisms 50 are arranged on two sides of the main frame unit 10. Each of the two swinging mechanisms 50 includes a rear swinging lever 51, a pivot member 52, and a lower swinging lever 53. The rear swinging lever 51 has an upper end pivotally connected with the first end 201 of one of the two drive levers 20. The rear swinging lever 51 has a lower end pivotally connected with a first end of the pivot member 52. The pivot member 52 has a second end pivotally connected with a rear end of the lower swinging lever 53.

The magnetically controlled resistance mechanism 60 is arranged on the front section of the main frame unit 10. The magnetically controlled resistance mechanism 60 is driven by a front end of the lower swinging lever 53 of each of the two swinging mechanisms 50, and provides a resistance to the two swinging mechanisms 50 (or the lower swinging lever 53 of each of the two swinging mechanisms 50).

The magnetically controlled resistance mechanism 60 at least includes a first belt wheel 61, a second belt wheel 64, a third belt wheel 67, a first rotation wheel 62, a second rotation wheel 65, a third rotation wheel 68, a fourth rotation wheel 70, a magnetically controlled wheel 71, and a magnetic bracket 72. The first belt wheel 61, the first rotation wheel 62, the third belt wheel 67, and the third rotation wheel 68 are pivotally mounted on a first side of the main frame unit 10. The second belt wheel 64, the second rotation wheel 65, the fourth rotation wheel 70, the magnetically controlled wheel 71, and the magnetic bracket 72 are pivotally mounted on a second side of the main frame unit 10. The magnetic bracket 72 surrounds a periphery of the magnetically controlled wheel 71. The first rotation wheel 62 is coaxial with the second belt wheel 64. The first rotation wheel 62 is rotated in concert with the second belt wheel 64 synchronously. The second rotation wheel 65 is coaxial with the third belt wheel 67. The second rotation wheel 65 is rotated in concert with the third belt wheel 67 synchronously. The third rotation wheel 68 is coaxial with the magnetically controlled wheel 71. The third rotation wheel 68 is rotated in concert with the magnetically controlled wheel 71 synchronously.

The magnetically controlled resistance mechanism 60 further includes a first transmission belt 63 mounted (or wound) around the first belt wheel 61 and the first rotation wheel 62, a second transmission belt 66 mounted (or wound) around the second belt wheel 64 and the second rotation wheel 65, and a third transmission belt 69 mounted (or wound) around the third belt wheel 67 and the third rotation wheel 68.

The first belt wheel 61 is coaxial with the fourth rotation wheel 70. The first belt wheel 61 is rotated in concert with the fourth rotation wheel 70 synchronously. The magnetically controlled resistance mechanism 60 further includes two cranks 74 pivotally connected with the first belt wheel 61 and the fourth rotation wheel 70 respectively. Each of the two cranks 74 is pivotally connected with the front end of the lower swinging lever 53 of one of the two swinging mechanisms 50.

In practice, when the lower swinging lever 53 of each of the two swinging mechanisms 50 swings, each of the two cranks 74 is driven. At this time, one of the two cranks 74 rotates the first belt wheel 61, and one of the two cranks 74 rotates the fourth rotation wheel 70. Thus, the first belt wheel 61 and the fourth rotation wheel 70 are rotated simultaneously. In such a manner, the first belt wheel 61 (or the fourth rotation wheel 70) rotates the first rotation wheel 62 which rotates the second belt wheel 64 which rotates the second rotation wheel 65 which rotates the third belt wheel 67 which rotates the third rotation wheel 68 which rotates the magnetically controlled wheel 71. Thus, the magnetically controlled wheel 71 is driven to rotate when the lower swinging lever 53 of each of the two swinging mechanisms 50 is driven. In addition, when the magnetically controlled wheel 71 is rotated, the magnetic bracket 72 provides a magnetic resistance or damping force to the magnetically controlled wheel 71 to enhance the exercising effect.

In the preferred embodiment of the present invention, the seat 19 is mounted on the front support 121.

In the preferred embodiment of the present invention, the swing base 41 is pivotally mounted on the rear support 122.

In the preferred embodiment of the present invention, the first end 201 of each of the two drive levers 20 is provided with a pivot ear 203 extending outward. The upper end of each of the two linkage rods 42 is pivotally connected with the pivot ear 203 of the first end 201 of one of the two drive levers 20. The upper end of the rear swinging lever 51 of each of the two swinging mechanisms 50 is pivotally connected with the pivot ear 203 of the first end 201 of one of the two drive levers 20. The upper end of the rear swinging lever 51 of each of the two swinging mechanisms 50 is coaxial with the upper end of each of the two linkage rods 42.

In the preferred embodiment of the present invention, the pivot member 52 of each of the two swinging mechanisms 50 is pivotally connected with the connecting bar 13 of the main frame unit 10. The pivot members 52 of the two swinging mechanisms 50 are swingably arranged on two sides of the connecting bar 13 of the main frame unit 10.

In the preferred embodiment of the present invention, at least one magnet is mounted in the magnetic bracket 72.

In the preferred embodiment of the present invention, the first belt wheel 61, the first rotation wheel 62, the second belt wheel 64, and fourth rotation wheel 70 are pivotally mounted on the connecting bar 13 of the main frame unit 10. The second rotation wheel 65, the third belt wheel 67, the third rotation wheel 68, the magnetically controlled wheel 71, and the magnetic bracket 72 are pivotally mounted on the handle support 11 of the main frame unit 10.

In the preferred embodiment of the present invention, a controller 100 is mounted on the handle support 11 of the main frame unit 10. The controller 100 includes a rope (or wire) pulling the magnetic bracket 72 so that the magnetic bracket 72 swings relative to the magnetically controlled wheel 71 and is moved toward or far from the magnetically controlled wheel 71.

In the preferred embodiment of the present invention, a first idler adjusting module 81 is mounted on the connecting bar 13 of the main frame unit 10 and presses the first transmission belt 63, a second idler adjusting module 82 is mounted on the handle support 11 of the main frame unit 10 and presses the second transmission belt 66, and a third idler adjusting module 83 is mounted on the handle support 11 of the main frame unit 10 and presses the third transmission belt 69.

Referring to FIGS. 8-11, the leg lift machine further comprises two handlebars 90 and two pivot levers 91. The two handlebars 90 are arranged at two sides of the support brace 14. Each of the two handlebars 90 is pivotally connected with the support brace 14. Each of the two handlebars 90 has a lower end pivotally connected with a front end of one of the two pivot levers 91. Each of the two pivot levers 91 has a rear end pivotally connected with one of the two cranks 74.

Figure 7:
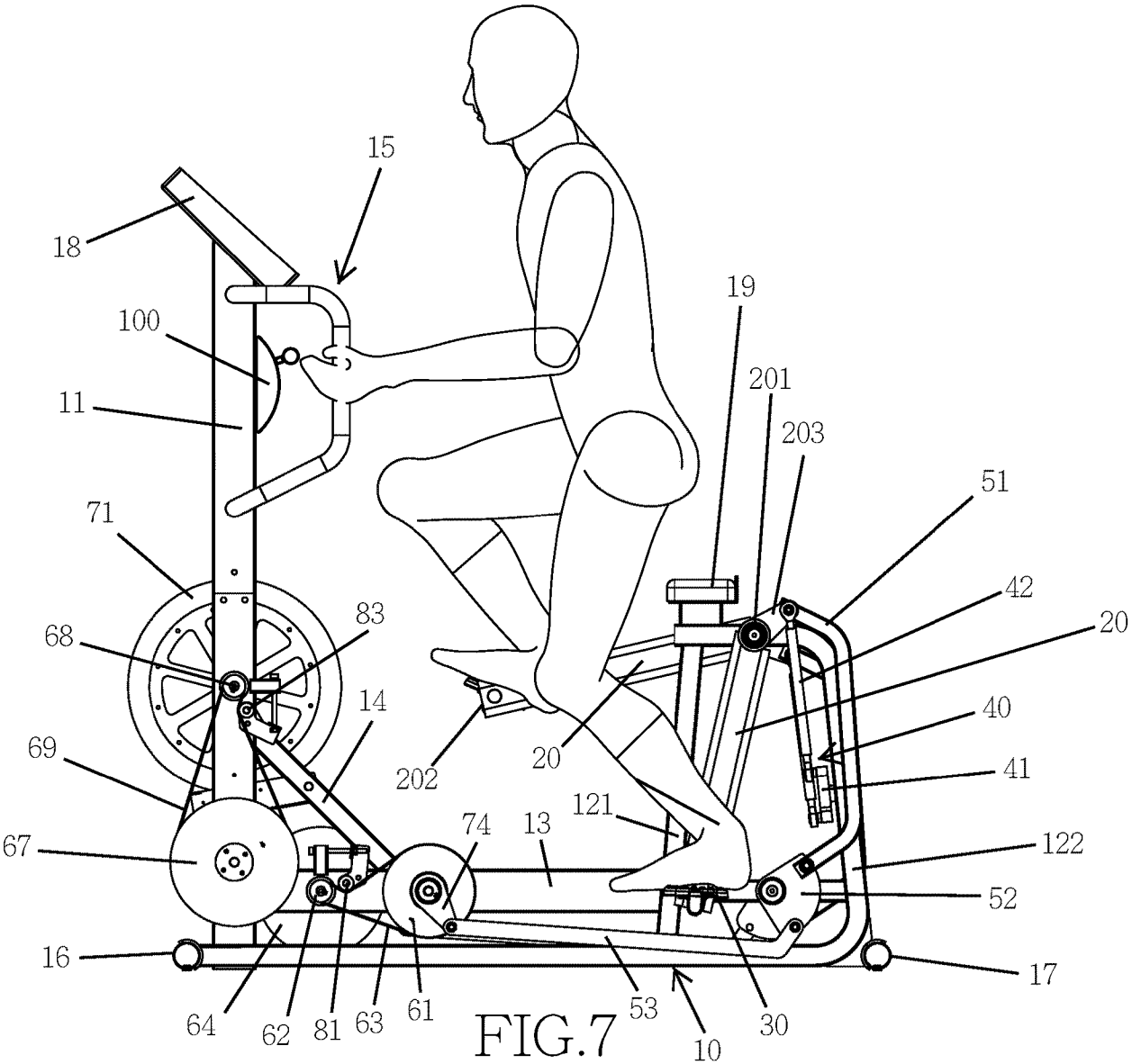
FIG. 7 is a side operational view of the leg lift machine as shown in FIG. 1.

In operation, referring to FIG. 7 with reference to FIGS. 1-6, the user sits on the seat 19, with his/her two hands holding the handle 15 and two feet treading the two pedals 30. In such a manner, the two pedals 30 drive and move the two drive levers 20, so that the two drive levers 20 are pivoted relative to the main frame unit 10 freely. At this time, each of the two linkage rods 42 is driven by the pivot ear 203 of the first end 201 of one of the two drive levers 20, and the swing base 41 is driven by the two linkage rods 42 so that the swing base 41 reciprocally swings leftward and rightward. In such a manner, the two drive levers 20 are limited by the swing base 41 and the two linkage rods 42 to reciprocally swing forward and backward. Thus, the two drive levers 20 reciprocally swing forward and backward and move along a curved trajectory. Therefore, the user raises legs to achieve an exercising effect.

At the same time, when the two drive levers 20 swing, the pivot ear 203 of the first end 201 of each of the two drive levers 20 in turn drives the rear swinging lever 51, the pivot member 52, and the lower swinging lever 53 of each of the two swinging mechanisms 50. In such a manner, when the lower swinging lever 53 of each of the two swinging mechanisms 50 swings, the two cranks 74 are driven to rotate the first belt wheel 61 and the fourth rotation wheel 70 which rotate the first rotation wheel 62 which rotates the second belt wheel 64 which rotates the second rotation wheel 65 which rotates the third belt wheel 67 which rotates the third rotation wheel 68 which rotates the magnetically controlled wheel 71. Thus, when the magnetically controlled wheel 71 is rotated, the magnetic bracket 72 provides a magnetic resistance to movement of the magnetically controlled wheel 71 to apply a damping force to the two drive levers 20 so that the user has to overcome the damping force to achieve the exercising effect.

It is noted that, the first belt wheel 61, the second belt wheel 64, and the third belt wheel 67 construct a belt wheel module which produces a larger speed ratio which feeds back and provides a larger resistance to the two drive levers 20 so that the user has to exert a larger force to overcome the resistance from the two drive levers 20, thereby greatly enhancing the exercising effect.

Figure 8:
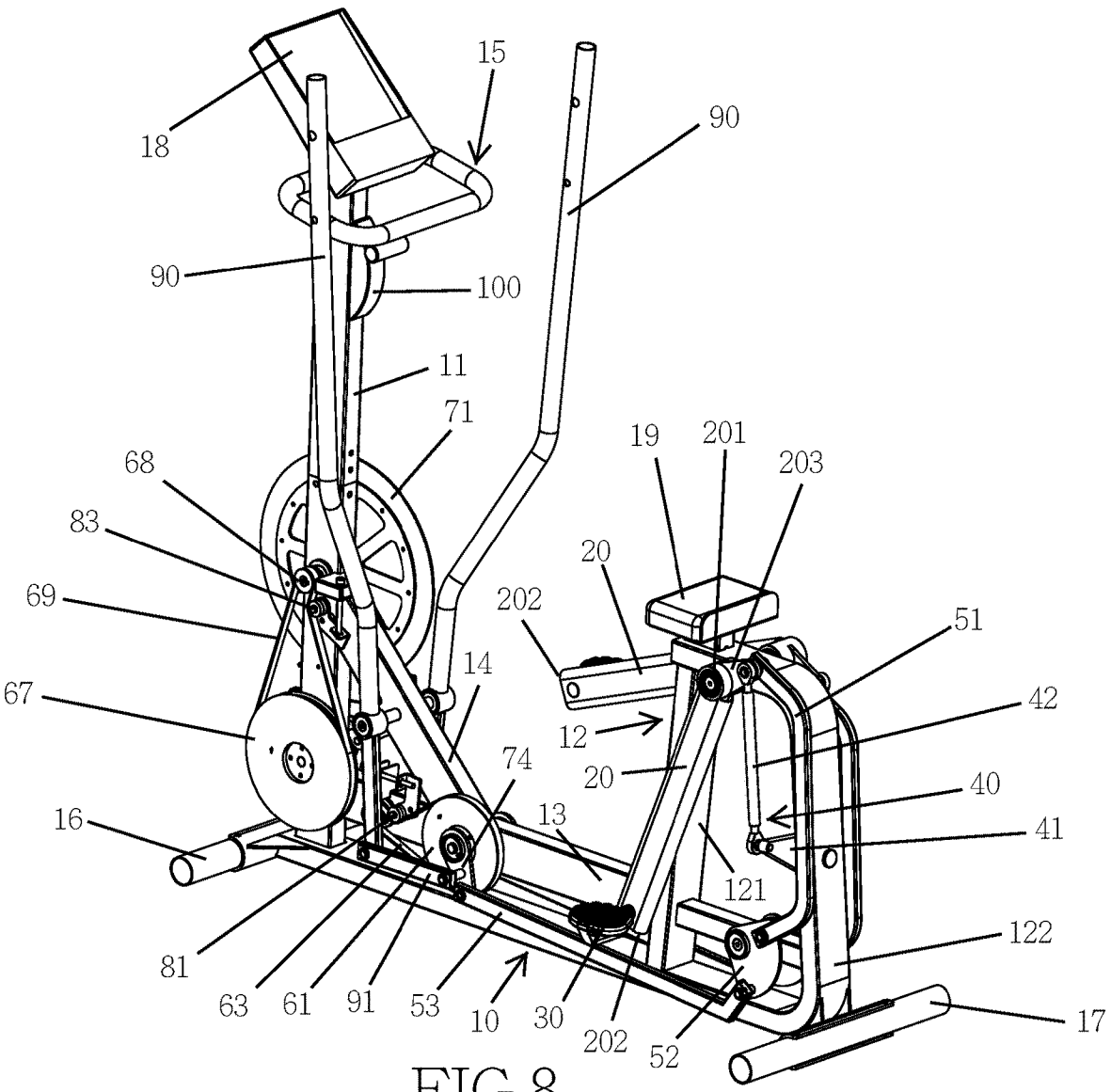
FIG. 8 is a perspective view of a leg lift machine in accordance with the second preferred embodiment of the present invention.
Figure 9:
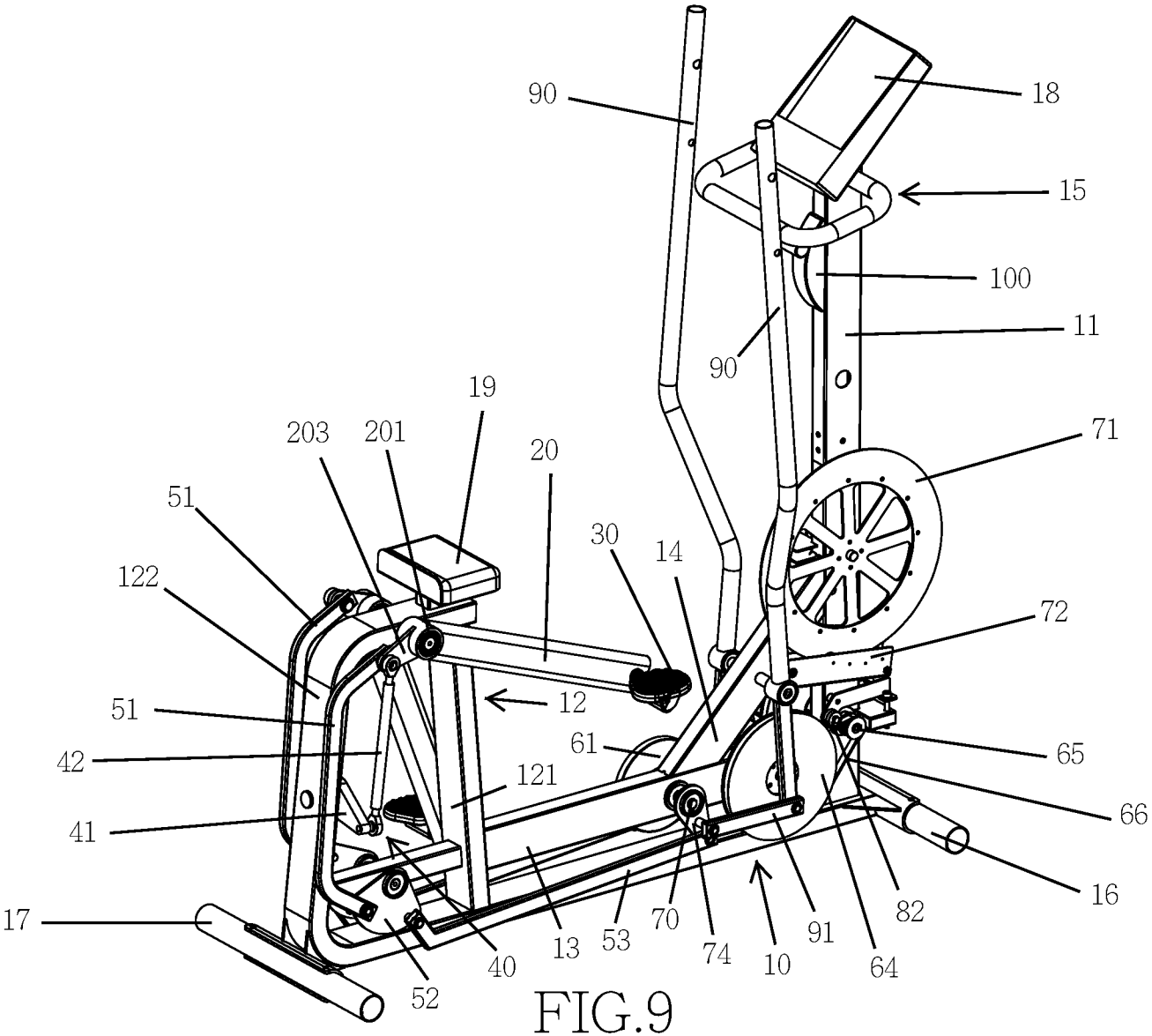
FIG. 9 is another perspective view of the leg lift machine as shown in FIG. 8.
Figure 10:
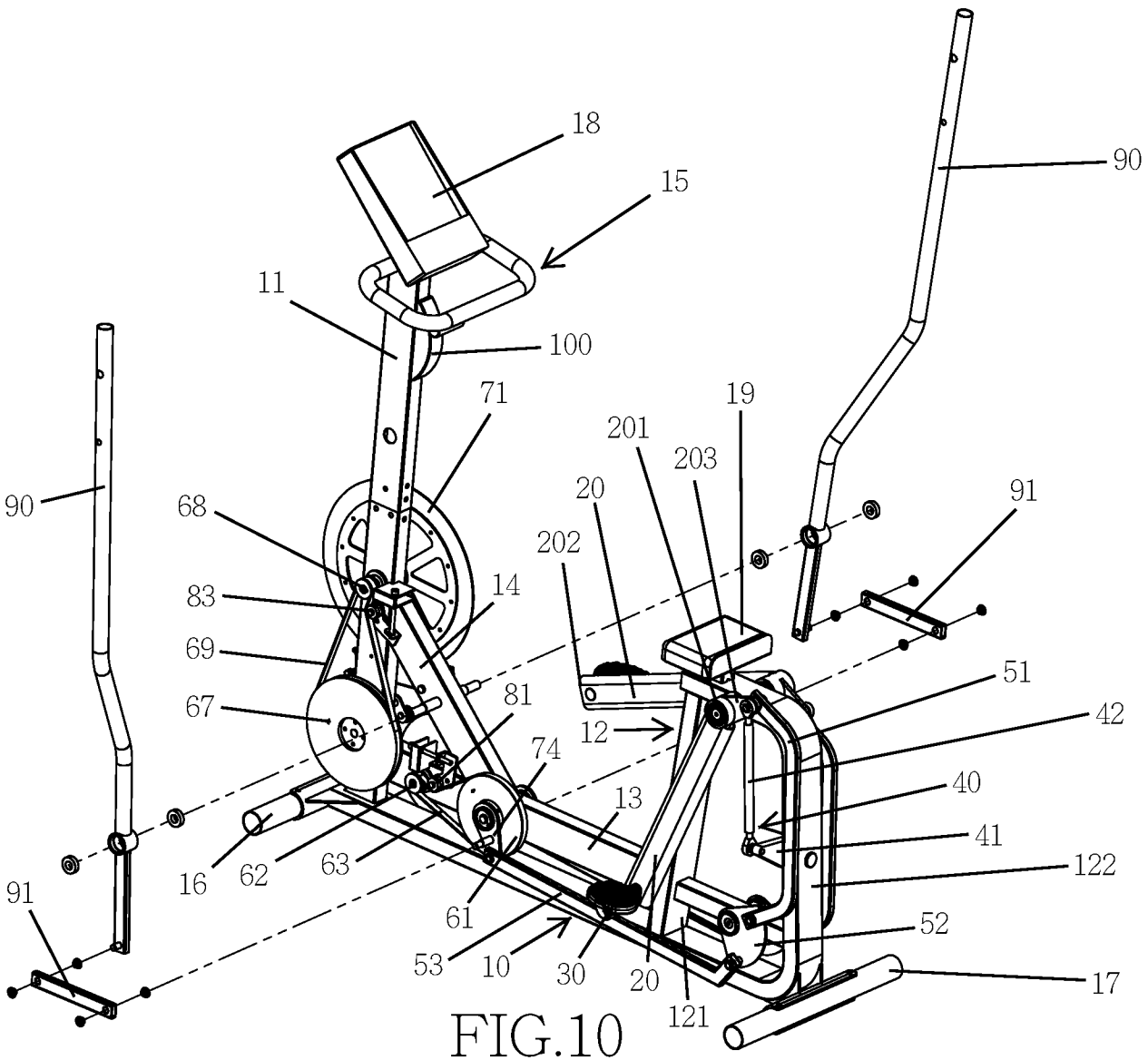
FIG. 10 is a partial exploded perspective view of the leg lift machine as shown in FIG. 8.
Figure 11:
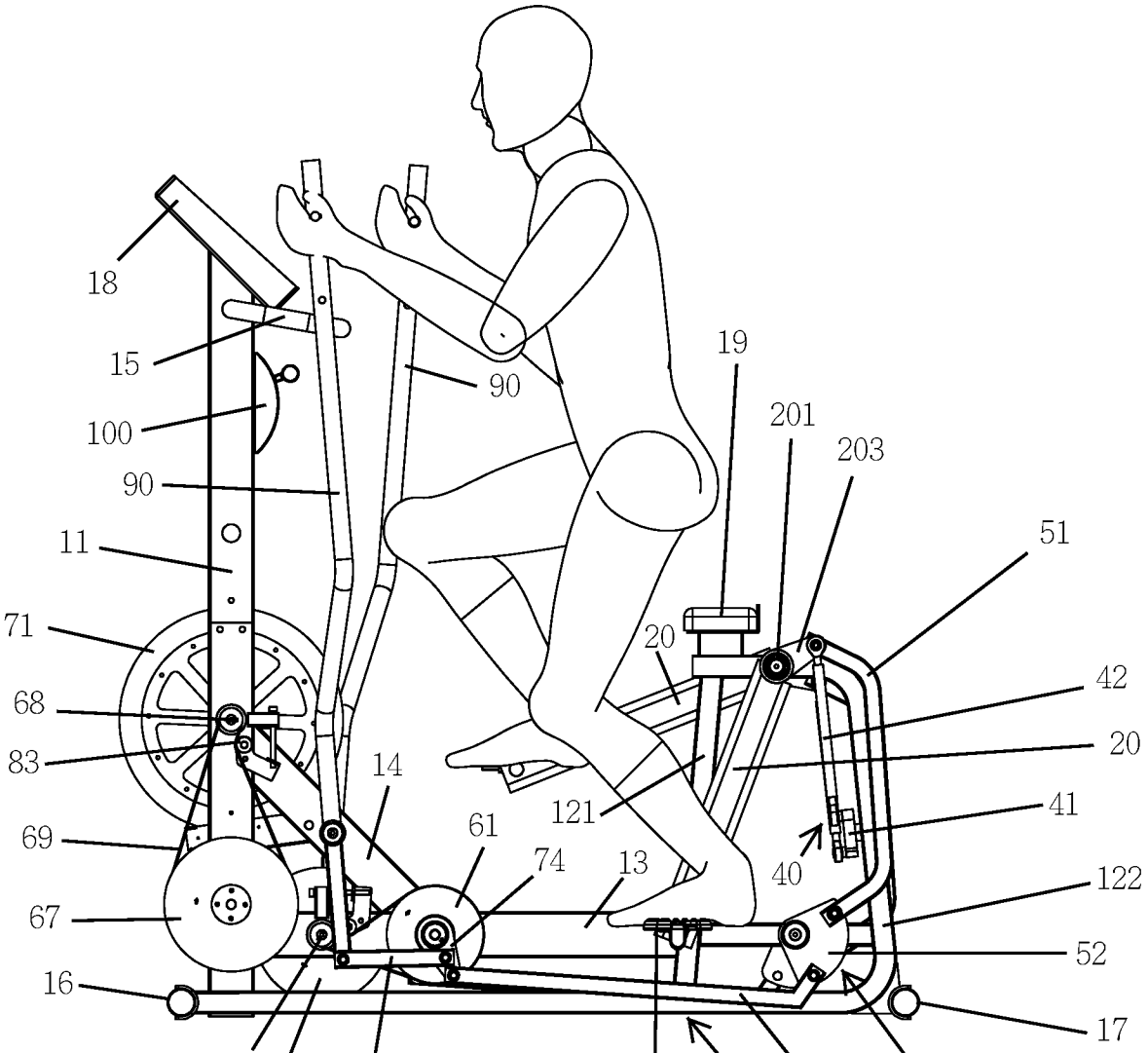
FIG. 11 is a side operational view of the leg lift machine as shown in FIG. 8.

Referring to FIG. 11 with reference to FIGS. 8-10, each of the two pivot levers 91 is pivotally connected with one of the two cranks 74. Thus, when the two cranks 74 are driven by the two drive levers 20 and the two swinging mechanisms 50, the two pivot levers 91 are driven so that the two handlebars 90 are driven to swing forward and backward.

Accordingly, the leg lift machine of the present invention has the following advantages.

1. The leg lift machine produces an interactive and reciprocal leg raising movement to effectively stretch the user's hips, knees, ankle joints, and to stretch core muscles such as the abdominal and buttock muscles.

2. The user's hands reciprocatingly sway and move forward and backward by provision of the two handlebars 90, to stretch the forearms, upper arms, triceps and other muscle groups.

3. The linkage mechanism 40 has a link type so that the linkage mechanism 40 is assembled easily and quickly, is not damaged easily, is easy to repair, and has a lower cost of assembly and fabrication.

4. The magnetically controlled resistance mechanism 60 includes multiple belt wheels which cooperate with the magnetically controlled wheel 71 to produce a larger speed ratio and to provide a larger resistance so that the magnetically controlled resistance mechanism 60 has a greater stability and is adjusted and repaired easily. In addition, the magnetically controlled wheel 71 has an inertia effect during rotation to produce a sport mode that is available for the user.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A leg lift machine comprising:

a main frame unit, a seat, two drive levers, two pedals, a linkage mechanism, two swinging mechanisms, and a magnetically controlled resistance mechanism;

wherein:

the main frame unit includes a handle support, a seat support module, and a connecting bar;

the handle support is arranged at a front section of the main frame unit;

the handle support is provided with a handle and a support brace;

the seat support module is arranged at a rear section of the main frame unit;

the seat support module includes a front support and a rear support;

the connecting bar is connected between the handle support and the seat support module;

the seat is mounted on the seat support module;

the two drive levers are arranged, respectively, on two sides of the seat support module;

each of the two drive levers has a first end and a second end;

the first end of each of the two drive levers is pivotally mounted on the seat support module;

the first end of each of the two drive levers is served as a rotation fulcrum, and the two drive levers are pivoted relative to the main frame unit and reciprocally swing forward and backward and move along a curved trajectory;

each of the two pedals is pivotally mounted on the respective second end of one of the two drive levers;

the linkage mechanism includes a swing base and two linkage rods;

the swing base is pivotally mounted on the seat support module and symmetrically swings leftward and rightward;

each of the two linkage rods has a lower end pivotally connected respectively with one of two ends of the swing base;

each of the two linkage rods has an upper end pivotally connected respectively with the first end of one of the two drive levers;

the two drive levers are limited by the swing base and the two linkage rods to reciprocally swing forward and backward;

the two swinging mechanisms are arranged, respectively, on two sides of the main frame unit;

each of the two swinging mechanisms includes a rear swinging lever, a pivot member, and a lower swinging lever;

each of the rear swinging levers has an upper end pivotally connected respectively with the first end of one of the two drive levers;

each of the rear swinging levers has a lower end pivotally connected with a respective first end of the pivot member;

the pivot member has a second end pivotally connected with a respective rear end of the lower swinging lever;

the magnetically controlled resistance mechanism is arranged on the front section of the main frame unit;

the magnetically controlled resistance mechanism is driven by a front end of the lower swinging lever, and provides a resistance to the lower swinging lever of each of the two swinging mechanisms;

the magnetically controlled resistance mechanism at least includes a first belt wheel, a second belt wheel, a third belt wheel, a first rotation wheel, a second rotation wheel, a third rotation wheel, a fourth rotation wheel, a magnetically controlled wheel, and a magnetic bracket;

the first belt wheel, the first rotation wheel, the third belt wheel, and the third rotation wheel are pivotally mounted on a first side of the main frame unit;

the second belt wheel, the second rotation wheel, the fourth rotation wheel, the magnetically controlled wheel, and the magnetic bracket are pivotally mounted on a second side of the main frame unit;

the magnetic bracket surrounds a periphery of the magnetically controlled wheel;

the first rotation wheel is coaxial with the second belt wheel;

the first rotation wheel is rotated in concert with the second belt wheel synchronously;

the second rotation wheel is coaxial with the third belt wheel;

the second rotation wheel is rotated in concert with the third belt wheel synchronously;

the third rotation wheel is coaxial with the magnetically controlled wheel;

the third rotation wheel is rotated in concert with the magnetically controlled wheel synchronously;

the magnetically controlled resistance mechanism further includes a first transmission belt mounted around the first belt wheel and the first rotation wheel, a second transmission belt mounted around the second belt wheel and the second rotation wheel, and a third transmission belt mounted around the third belt wheel and the third rotation wheel;

the first belt wheel is coaxial with the fourth rotation wheel;

the first belt wheel is rotated in concert with the fourth rotation wheel synchronously;

the magnetically controlled resistance mechanism further includes two cranks pivotally connected with the first belt wheel and the fourth rotation wheel respectively; and each of the two cranks is pivotally connected with the front end of the lower swinging lever of one of the two swinging mechanisms.

2. The leg lift machine as claimed in claim 1, wherein the seat is mounted on the front support.

3. The leg lift machine as claimed in claim 1, wherein the swing base is pivotally mounted on the rear support.

4. The leg lift machine as claimed in claim 1, wherein:

the first end of each of the two drive levers is provided with a pivot ear extending outward;

the upper end of each of the two linkage rods is pivotally connected with the pivot ear of one of the two drive levers;

the upper end of the rear swinging lever of each of the two swinging mechanisms is pivotally connected with the pivot ear of one of the two drive levers; and the upper end of the rear swinging lever of each of the two swinging mechanisms is coaxial with the upper end of each of the two linkage rods.

5. The leg lift machine as claimed in claim 1, wherein:

the pivot member of each of the two swinging mechanisms is pivotally connected with the connecting bar; and the pivot members of the two swinging mechanisms are swingably arranged on two sides of the connecting bar.

6. The leg lift machine as claimed in claim 1, wherein at least one magnet is mounted in the magnetic bracket.

7. The leg lift machine as claimed in claim 1, wherein:

the first belt wheel, the first rotation wheel, the second belt wheel, and fourth rotation wheel are pivotally mounted on the connecting bar; and the second rotation wheel, the third belt wheel, the third rotation wheel, the magnetically controlled wheel, and the magnetic bracket are pivotally mounted on the handle support.

8. The leg lift machine as claimed in claim 1, wherein:

a controller is mounted on the handle support; and the controller includes a rope pulling the magnetic bracket so that the magnetic bracket swings relative to the magnetically controlled wheel and is moved toward or far from the magnetically controlled wheel.

9. The leg lift machine as claimed in claim 1, wherein:

a first idler adjusting module is mounted on the connecting bar and presses the first transmission belt;

a second idler adjusting module is mounted on the handle support and presses the second transmission belt; and a third idler adjusting module is mounted on the handle support and presses the third transmission belt.

10. The leg lift machine as claimed in claim 1, further comprising:

two handlebars and two pivot levers;

wherein:

the two handlebars are arranged, respectively, at two sides of the support brace;

each of the two handlebars is pivotally connected with the support brace;

each of the two handlebars has a lower end pivotally connected with a front end of one of the two pivot levers;

each of the two pivot levers has a rear end pivotally connected with one of the two cranks.

* * * * *